US011225825B2

(12) United States Patent
McKenna et al.

(10) Patent No.: US 11,225,825 B2
(45) Date of Patent: Jan. 18, 2022

(54) THERMAL SEPARATOR WITH INTEGRATED FLUID SEAL

(71) Applicant: Arconic Technologies LLC, Pittsburgh, PA (US)

(72) Inventors: Gregory Blake McKenna, Cumming, GA (US); Jeffrey Scott Dolby, Buford, GA (US)

(73) Assignee: Arconic Technologies LLC, Pittsburgh, PA (US)

( * ) Notice: Subject to any disclaimer, the term of this patent is extended or adjusted under 35 U.S.C. 154(b) by 0 days.

(21) Appl. No.: 17/041,197

(22) PCT Filed: Jun. 12, 2018

(86) PCT No.: PCT/US2018/037024
§ 371 (c)(1),
(2) Date: Sep. 24, 2020

(87) PCT Pub. No.: WO2019/240765
PCT Pub. Date: Dec. 19, 2019

(65) Prior Publication Data

US 2021/0054679 A1 Feb. 25, 2021

(51) Int. Cl.
*E06B 3/54* (2006.01)
*E04B 2/96* (2006.01)
(Continued)

(52) U.S. Cl.
CPC ..... *E06B 3/549* (2013.01); *E04B 2/967* (2013.01); *E06B 3/26* (2013.01); *E06B 3/26301* (2013.01); *E06B 7/2301* (2013.01); *E06B 7/2314* (2013.01)

(58) Field of Classification Search
CPC .. E06B 3/26301; E06B 3/256305; E06B 3/49; E06B 2003/2631; E06B 2003/26309;
(Continued)

(56) References Cited

U.S. PATENT DOCUMENTS 3,466,826 A * 9/1969 Gallagher ..... E06B 3/26336 52/395
6,141,923 A * 11/2000 Habicht ..... E04B 1/943 52/235
(Continued)

FOREIGN PATENT DOCUMENTS

DE 2848810 A1 * 5/1980 ..... E06B 3/68
DE 3221797 A1 * 12/1983 ..... B29C 65/4835
(Continued)

OTHER PUBLICATIONS

Machine translation for DE-2848810. Accessed on Jul. 3, 2021.*
Machine translation for DE-3221797. Accessed on Jul. 3, 2021.*
ISRWO in related PCT/US2018/037024 dated Mar. 11, 2019.

*Primary Examiner* — Christine T Cajilig
(74) *Attorney, Agent, or Firm* — Vorys, Sater, Seymour and Pease LLP

(57) ABSTRACT

A window system for a building includes a panel and a first element assembly that supports the panel and includes a cross member and a pressure plate laterally offset from the cross member. A glazing pocket is defined between the cross member and the pressure plate, and a thermal separator is positioned within the glazing pocket and extends between the pressure plate and the cross member. The thermal separator includes a tongue extension and a rod gasket seals an interface between the tongue extension and the cross member.

19 Claims, 6 Drawing Sheets

(51) Int. Cl.
*E06B 3/26* (2006.01)
*E06B 3/263* (2006.01)
*E06B 7/23* (2006.01)

(58) Field of Classification Search
CPC ..... E06B 2003/26363; E06B 3/26; E06B 7/2301; E06B 7/2314
See application file for complete search history.

(56) References Cited

U.S. PATENT DOCUMENTS

| | | | | |
|---|---|---|---|---|
| 8,225,561 | B2 | 7/2012 | Voegele, Jr. et al. | |
| 8,555,576 | B2 * | 10/2013 | Falk | E04B 2/967 52/235 |
| 9,212,482 | B2 * | 12/2015 | Frederick | E04B 2/96 |
| 10,443,234 | B2 * | 10/2019 | Stronks | E04B 2/965 |
| 10,450,743 | B2 * | 10/2019 | Frederick | E04B 2/967 |
| 2006/0201084 | A1 | 9/2006 | Arias | |
| 2015/0284951 | A1 * | 10/2015 | Frederick | E04B 2/90 52/235 |
| 2016/0069073 | A1 * | 3/2016 | Grise | E04B 1/6801 52/235 |
| 2017/0022708 | A1 | 1/2017 | Dolby et al. | |

FOREIGN PATENT DOCUMENTS

| | | | | |
|---|---|---|---|---|
| DE | 2848810 | C2 * | 11/1984 | E04B 2/967 |
| DE | 102014112145 | A1 * | 2/2016 | E06B 3/26305 |
| WO | WO-2019180502 | A2 * | 9/2019 | F21V 33/006 |

* cited by examiner

THERMAL SEPARATOR WITH INTEGRATED FLUID SEAL

BACKGROUND

Windows are commonly used in residential and commercial buildings, e.g., in storefronts and in curtain walls used on the façade of high-rise buildings. Aesthetic considerations play an important part in architectural design, including the design of window systems and curtain walls. The overall energy efficiency of a building, including energy transfer characteristics of windows, is another important factor in architectural design, and there is a continued demand for building features and methods of construction that improve energy efficiency.

Some windows utilize frames made of metal, such as aluminum or an aluminum alloy. Metal frames are particularly good thermal conductors. Thus, improved and/or alternative structures and methods for controlling the heat transfer characteristics of windows, window structures, curtain walls, and curtain wall assemblies and for achieving aesthetic design objectives remain desirable.

One solution to improving heat transfer characteristics in windows, window structures and curtain wall assemblies is to place a thermal separation or separator between inner and outer component structures. The thermal separator may be made of materials that exhibit low thermal conductivity. Incorporating additional component structures to windows and curtain walls, however, can simultaneously increase the potential for fluid (e.g., water) leaks.

SUMMARY OF THE INVENTION

A window system for a building is disclosed and may include a panel and a first element assembly that supports the panel. The first element assembly may include a cross member and a pressure plate laterally offset from the cross member. A glazing pocket may be defined between the cross member and the pressure plate. A thermal separator may be positioned within the glazing pocket and may extend between the pressure plate and the cross member. The thermal separator may include a tongue extension. A rod gasket may also be included to seal an interface between the tongue extension and the cross member.

A method of sealing a portion of a window system is also disclosed and may include supporting a panel with a first element assembly that includes a cross member and a pressure plate laterally offset from the cross member. A glazing pocket may be defined between the cross member and the pressure plate. A thermal separator may be positioned within the glazing pocket and may extend between the pressure plate and the cross member and may include a tongue extension. An interface between the tongue extension and the cross member may be sealed with a rod gasket.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure is related to building products and, more particularly, to window structures, window frames, curtain walls, and curtain wall assemblies with improved seals.

Embodiments discussed herein describe a window system for a building that helps prevent water leakage. The window system can include a panel and a first, horizontal element assembly that supports the panel and includes a horizontal cross member and a pressure plate laterally offset from the horizontal cross member. A glazing pocket may be defined between the horizontal cross member and the pressure plate, and a thermal separator may be positioned within the glazing pocket and may extend between the pressure plate and the horizontal cross member. The thermal separator may include a tongue extension and a rod gasket may seal an interface between the tongue extension and the horizontal cross member. Accordingly, any water that migrates into the glazing pocket may be unable to migrate across the interface between the tongue extension and the horizontal cross member.

In additional embodiments, a second, vertical element assembly may be included to laterally support the panel. The vertical element assembly may include a transverse (vertical) member and a second pressure plate laterally offset from the vertical member. A second glazing pocket may be defined between the vertical member and the second pressure plate. A second thermal separator may be positioned within the second glazing pocket and may extend between the second pressure plate and the vertical member. The second thermal separator may include a second tongue extension, and a second rod gasket may seal an interface between the second tongue extension and the vertical member.

Figure 1:
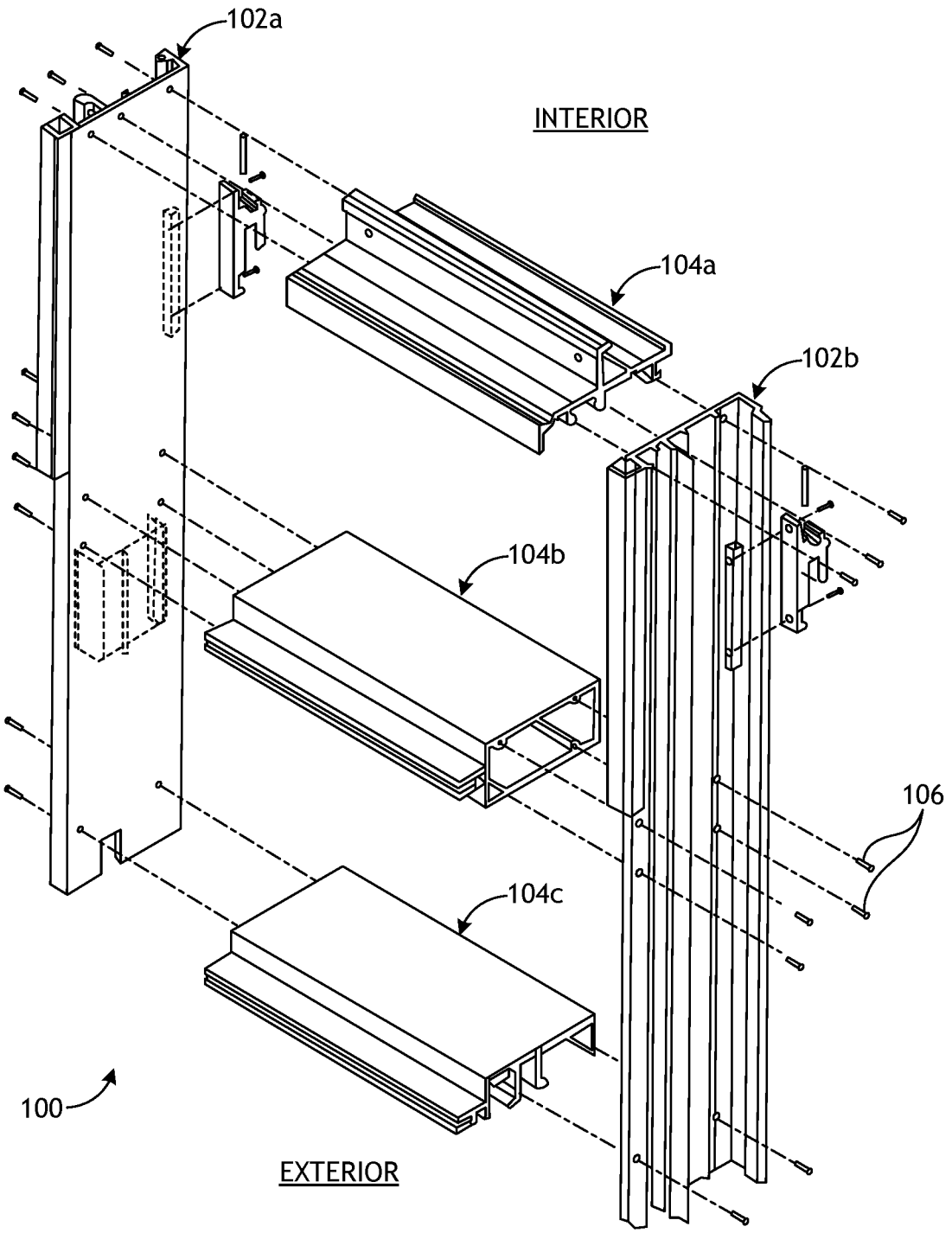
FIG. 1 is an exploded, perspective view of an example window wall chassis subassembly.

FIG. 1 is an isometric exploded view of an example window chassis subassembly 100. The chassis subassembly 100 may form part of a window system or a curtain wall for a building, for example. As illustrated, the chassis subassembly 100 may include vertical elements 102*a* and 102*b*, and horizontal elements 104*a*, 104*b*, and 104*c*. The vertical and horizontal elements 102*a,b* and 104*a-c* may be adapted to cooperatively frame and hold a panel, such as a pane of window glass, polycarbonate, or another clear, translucent, tinted, or opaque panel. In at least one embodiment, the vertical and horizontal elements 102*a,b*, 104*a-c* may be adapted to frame and hold a plurality of glazing panels (e.g., the glazing panels 208*a*-208*j* of FIG. 2). The vertical elements 102*a,b* and horizontal elements 104*a-c* may be joined by one or more fasteners 106 to form the chassis subassembly 100. The fasteners 106, which may be mechanical fasteners, may include, but are not limited to, screws, rivets, welds, other known fastening means, or any combination thereof. In some embodiments the fasteners 106 may alternatively comprise magnets or the like.

The chassis subassembly 100 may be made for installation in a large commercial building, such as a skyscraper. In such embodiments, the vertical elements 102*a,b* and horizontal elements 104*a-c* may be extruded from an aluminum alloy, which is strong, lightweight and corrosion-resistant. Of course, the second, vertical elements 102*a,b* and first, horizontal elements 104*a-c* may also be formed of other materials, including, but not limited to, other metals and alloys. It will be appreciated, however, that the technology of the present disclosure may also be applied to smaller commercial or residential buildings, without departing from the scope of the disclosure.

Figure 2:
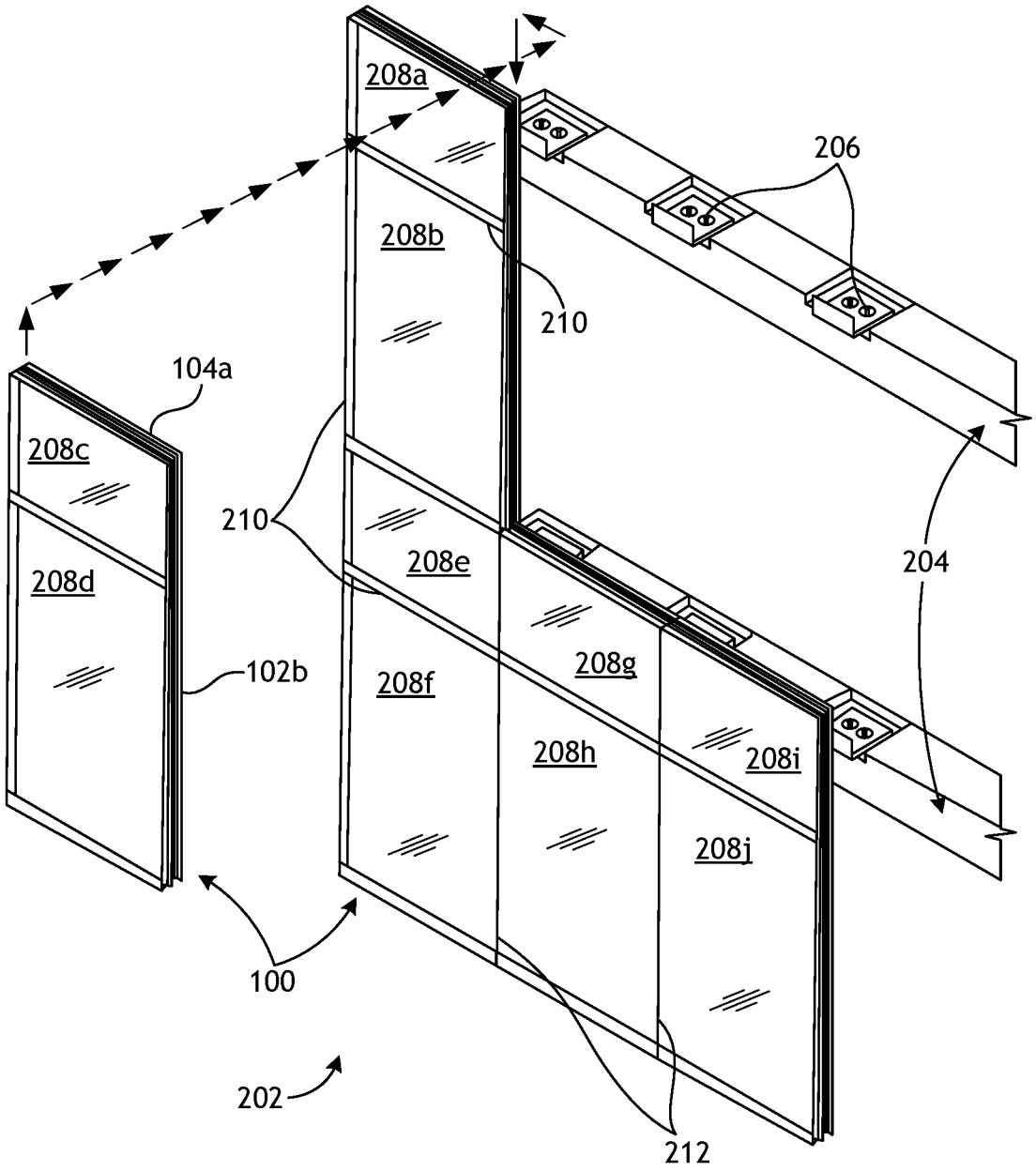
FIG. 2 is an isometric view of a plurality of chassis subassemblies assembled to form a portion of a window system.

FIG. 2 is an isometric view of a plurality of chassis subassemblies 100 assembled to form a portion of a window system 202, alternately referred to as a "curtain wall." The window system 202 may be secured to a building structure, such as one or more beams 204 that form part of the building structure. The chassis subassemblies 100 may be coupled to one another and to one or more brackets 206 secured to the beams 204.

The chassis subassemblies 100 have a plurality of glazing panels 208*a*-208*j* (e.g., glass), alternately referred to as "glazing units," installed therein between the vertical and horizontal elements (102*b* and 104*a* shown). In modern construction, the glazing panels 208*a-j* are typically double or triple glazed with air, an inert gas, and/or a plastic film(s) between adjacent panels to control transmission of thermal energy by radiation and convection between the interior of the building and the exterior environment.

In some embodiments, the glazing panels 208*a-j* may be secured to the corresponding chassis subassemblies 100 by way of a silicone adhesive/sealant or structural tape. In other embodiments, however, one or more cover elements or "covers" 210 may be utilized. The covers 210 may provide an architectural finishing detail between adjacent glazing panels 208*a-j* and/or provide a mechanism for supporting the glazing panels 208*a-j* in place on the window system 202, e.g., as a back-up or supplemental support for a glazing unit, which is adhered to the chassis subassembly 100. The covers 210 may also help insulate and occlude gaps 212 between adjacent glazing panels 208*a-j* and help prevent the influx of foreign matter, such as dirt, leaves, debris, insects (e.g., bees, wasps, etc.), birds, etc. into the gaps 212. The covers 210 may also help reduce wind noise generated by air flowing through or proximate the gaps 212.

Figure 3:
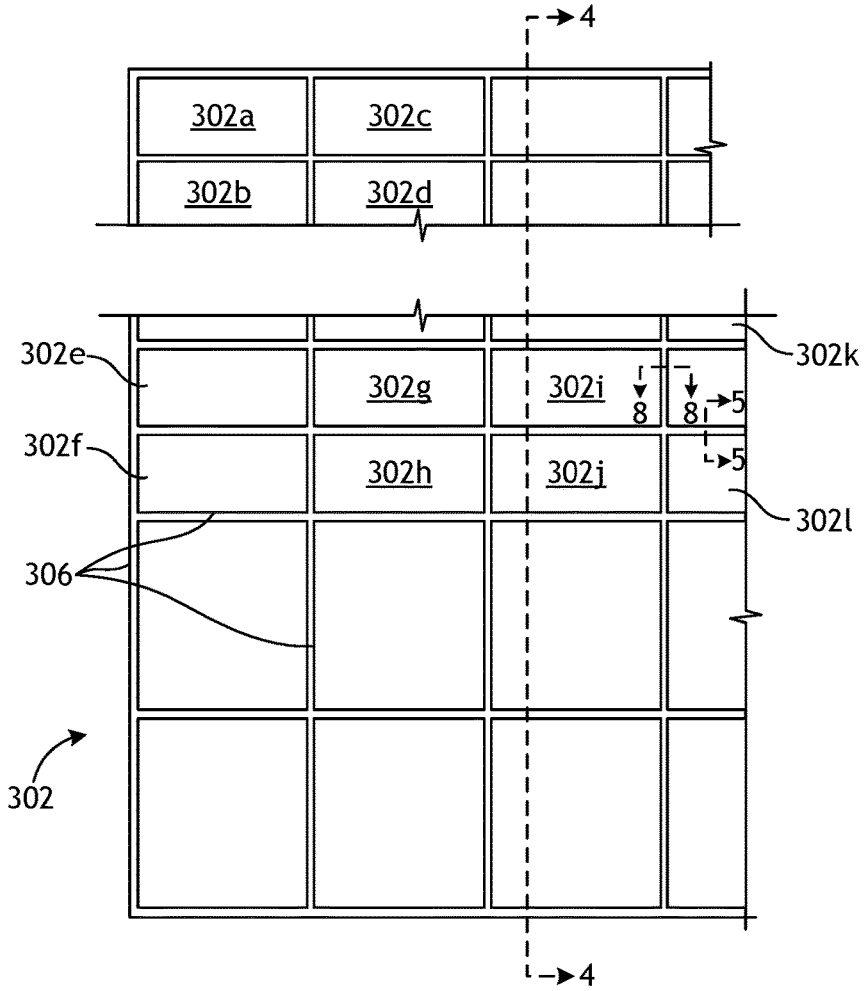
FIG. 3 is a front view of a portion of another example window system.
Figure 4:
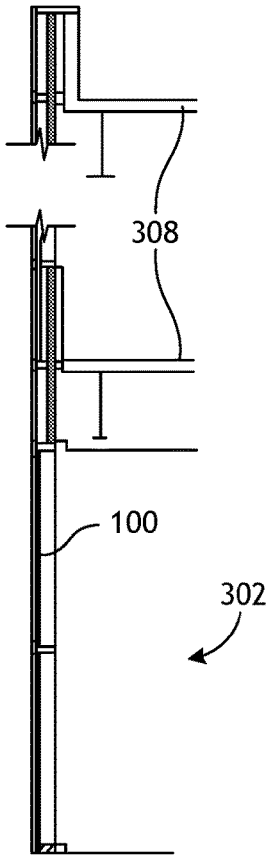
FIG. 4 is a side view of the curtain wall of FIG. 3 taken along lines 4-4 in FIG. 3.

FIG. 3 is a front view of a portion of another example window system 302, alternately referred to as a "curtain wall," and FIG. 4 is a side view of the window system 302 taken along the dashed line 4-4. The window system 302 may be similar in some respects to the window system 202 of FIG. 2, and therefore may be best understood with reference thereto. For example, the window system 302 includes a plurality of glazing panels 302*a*-1 and a corresponding plurality of covers 306. Moreover, the above-described chassis subassemblies 100 may be used to help fasten the window system 302 to a building structure 308. In the illustrated embodiment, the window system 302 is "fully captured" in that the glazing panels 302*a*-1 are surrounded on all sides by the covers 306 in the vertical and horizontal directions.

The window system 302 may incorporate one or more features of the present disclosure. More specifically, the structures revealed at the cross-sections taken at lines 5-5 and 8-8 and shown in FIGS. 5 and 8, respectively, represent structures in accord with the present disclosure.

Figure 5:
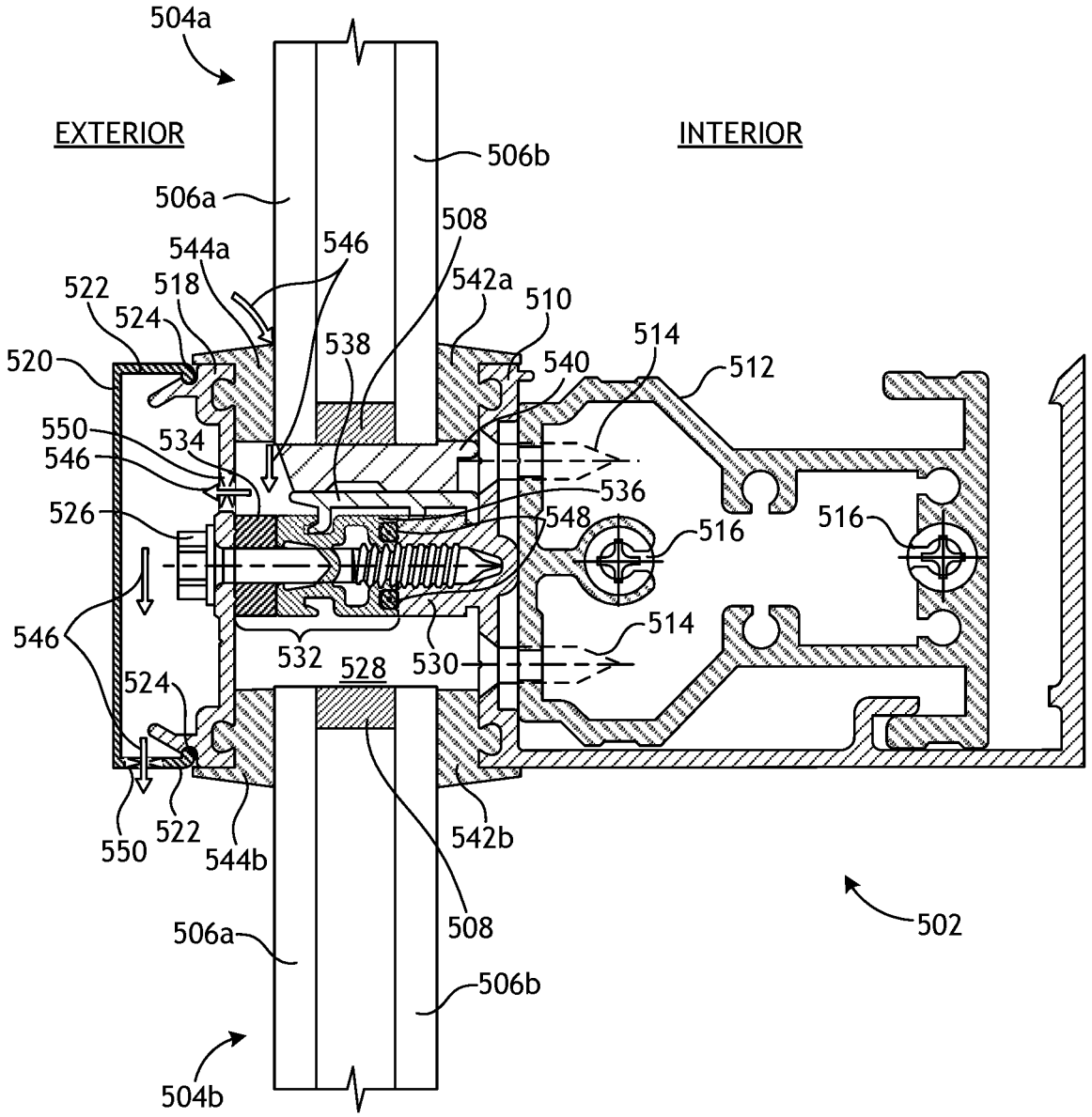
FIG. 5 is a cross-sectional side view of an example first, horizontal element assembly taken along lines 5-5 in FIG. 3, which includes a transom and a tongue extension.

FIG. 5 is a cross-sectional side view of an example horizontal element assembly 502, according to one or more embodiments. The horizontal element assembly 502 may be similar in some respects to the horizontal elements 104*a-c* of FIG. 1 and may thus be horizontally oriented. In some embodiments, the horizontal element assembly 502 may replace one or all of the horizontal elements 104*a-c*. Accordingly, the horizontal element assembly 502 may not only form part of the window system 302 of FIG. 3, but may also form part of the window system 202 of FIG. 2.

The horizontal element assembly 502 may be configured to help support and/or secure one or more panels, shown in FIG. 5 as an upper panel 504*a* and a lower panel 504*b*. In the illustrated embodiment, the upper and lower panels 504*a,b* may comprise glazing panels and thus may be referred to herein as upper and lower "glazing" panels 504*a,b*. It will be appreciated, however, that the panels 504*a,b* may alternatively comprise one or more panes of window glass, one or more panes of polycarbonate, or one or more panels of material that are clear, translucent, tinted, or opaque, without departing from the scope of the disclosure.

As illustrated each glazing panel 504*a,b* includes a first or "exterior" glass panel 506*a* and a second or "interior" glass panel 506*b* with a spacer 508 positioned therebetween. The space between the first and second glass panels 506*a,b* may be filled with air or an inert gas to help control transmission of thermal energy by radiation and convection between the interior of the building and the exterior environment. Alternatively, one or more plastic films may be positioned within the space to help control transmission of thermal energy. Accordingly, the glazing panels 504*a,b* may each comprise a conventional "double-glazed" window arrangement. It will be appreciated, however, that the principles of the present disclosure may be equally applicable to other glazing panel designs and configurations, without departing from the scope of the disclosure.

As illustrated, the horizontal element assembly 502 may include a horizontal cross member 510 (alternately referred to as a "transom") and a shear block 512. One or both of the horizontal cross member 510 and the shear block 512 may comprise a rigid extrusion, such as being made of aluminum or an aluminum alloy. In at least one embodiment, the horizontal cross member 510 may be coupled to the shear block 512 using one or more fasteners 514 (two shown), such as screws, bolts, rivets, etc. The shear block 512, in turn, may be coupled to a vertical element (e.g., vertical elements 102*a,b* of FIG. 1) using one or more additional fasteners 516.

The horizontal element assembly 502 may further include a pressure plate 518 and a cover 520 removably coupled to the pressure plate 518. The cover 520 may be similar to the covers 210 of FIG. 2 and, therefore, may provide an architectural finishing detail while simultaneously covering a horizontal gap between the upper and lower glazing panels 504*a,b*. In some embodiments, as illustrated, the cover 520 may provide upper and lower lateral extensions 522 receivable within corresponding recesses 524 provided on the pressure plate 518 in a snap-fit or interference fit engagement. It will be appreciated, however, that the cover 520 may be coupled to the pressure plate 518 via other means of engagement, without departing from the scope of the disclosure.

The pressure plate 518 may be operatively coupled to the horizontal cross member 510 with one or more fasteners 526 (one shown), which may be mechanical fasteners, that extend through a glazing pocket 528 defined laterally between the horizontal cross member 510 and the pressure plate 518. The glazing pocket 528 may also be defined vertically between the upper and lower glazing panels 504*a,b*. In the illustrated embodiment, the fastener 526 comprises a screw that may be received within or otherwise threaded into a tongue 530 extending from or forming part of the horizontal cross member 510.

A thermal separator 532 may be positioned within the glazing pocket 528 and may interpose and otherwise extend between the pressure plate 518 and the horizontal cross member 510. The fastener 526 may be configured to extend at least partially through or penetrate the thermal separator 532 to reach the horizontal cross member 510 and, more particularly, the tongue 530. In the illustrated embodiment, the thermal separator 532 includes a thermal barrier 534 positioned adjacent the pressure plate 518 and a tongue extension 536 positioned adjacent the horizontal cross member 510 and, more particularly, the tongue 530.

The thermal separator 532 may be configured to reduce the conductive pathway for thermal energy between the exterior environment of a building and the climate controlled interior of the building. More specifically, the horizontal cross member 510, the shear block 512, the pressure plate 518, and the cover 520 may each be made of a metal (e.g., aluminum, steel, etc.), and therefore each may exhibit a high thermal conductivity. In contrast, the thermal separator 532 may be made of one or more materials that are less thermally conductive, and thus capable of reducing thermal heat transfer between the pressure plate 518 and the horizontal cross member 510. In at least one embodiment, for example, the thermal separator may be made of a material having a thermal conductivity that is less than about 0.52 W/mK (3.60 Btu-in/hr-ft$^2$-° F.).

In some embodiments, for example, the thermal barrier 534 may be made of a rubber or an elastomer. In such embodiments, the thermal barrier 534 may operate as a seal against the inner wall of the pressure plate 518. Moreover, the tongue extension 536 may be made of a polymer, such as polyamide. In such embodiments, the tongue extension 536 may be referred to as a "polyamide." In other embodiments, however, the tongue extension 536 may be made of other low conductance polymers such as, but not limited to, acrylonitrile butadiene styrene (ABS), polyvinyl chloride (PVC), polypropylene or another polymer. In yet other embodiments, the tongue extension 536 may be made of fiberglass or another composite material, without departing from the scope of the disclosure.

The horizontal element assembly 502 may further include a panel chair 538 and a setting block 540. The panel chair 538 and the setting block 540 may be at least partially positioned within the glazing pocket 528 and used to help position and support the upper glazing panel 504*a* under the influence of gravity. The panel chair 538 may extend between the horizontal cross member 510 and the tongue extension 536. In some embodiments, as illustrated, the panel chair 538 may include one or more tabs or extensions designed or otherwise configured to allow the panel chair 538 to be keyed into the horizontal cross member 510 and the tongue extension 536 on opposing sides. The panel chair 538 may be made of aluminum, but may alternatively be made of other materials, such as steel, fiberglass, a polymer, etc.

The setting block 540 may interpose the upper glazing panel 504*a* and the panel chair 538. Accordingly, the upper glazing panel 504*a* may rest directly on the setting block 540. In some embodiments, the setting block 540 may be made of rubber or an elastomer, but may alternatively be made of a polymer, without departing from the scope of the disclosure.

An upper interior gasket 542*a* and a lower interior gasket 542*b* may be positioned to interpose the upper and lower glazing panels 504*a,b*, respectively, and the horizontal cross member 510. Similarly, an upper exterior gasket 544*a* and a lower exterior gasket 544*b* may interpose the upper and lower glazing panels 504*a,b*, respectively, and the pressure plate 518. The interior gaskets 542*a,b* may provide a substantially sealed interface between the glazing panels 504*a,b* and the horizontal cross member 510 on the interior of a building, and the exterior gaskets 544*a,b* may provide a substantially sealed interface between the glazing panels 504*a,b* and the pressure plate 518 on the exterior of the building. Accordingly, the interior and exterior gaskets 542*a,b* and 544*a,b* may operate to help prevent the migration of fluids (e.g., water, air, etc.) into the glazing pocket 528.

While the upper exterior gasket 544*a* may be designed to provide a sealed interface between the upper glazing panel 504*a* and the pressure plate 518, there may be a possibility of fluid 546 (e.g., water) migrating into the glazing pocket 528. This may occur, for example, as a result of seal breakdown through thermal expansion and contraction, improper workmanship or condensation. If the fluid 546 enters the glazing pocket 528, it may be desirable to prevent the fluid 546 from migrating downward and coming into contact with the lower glazing panel 504*b*, which may result in a leak through lower interior gasket 542*b* or a failure of the spacer 508 in the lower glazing panel 504*b*.

According to embodiments of the present disclosure, the thermal separator 532 may provide a sealed interface at one or both of its opposing sides (e.g., to the left and right in FIG. 5) against the horizontal cross member 510 and the pressure plate 518, respectively. More particularly, at one side of the thermal separator 532, one or more rod gaskets 548 (two shown) may be configured to seal the interface between the tongue extension 536 and the opposing tongue 530. At the opposite side, the thermal barrier 534 may sealingly engage the inner wall of the pressure plate 518. As a result, fluids 546 that find their way into the glazing pocket 528 may be generally unable to migrate further within the glazing pocket 528 and thereby come into contact with the lower glazing panel 504*b*.

Rather, fluids 546 within the glazing pocket 528 may be able to drain from the glazing pocket 528 via one or more weep holes 550 defined in the pressure plate 518 and the cover 520. In the illustrated embodiment, a single weep hole 550 is defined in each of the pressure plate 518 and the cover 520, but it will be appreciated that more than one weep hole 550 may be employed in each component part, without departing from the scope of the disclosure.

Figure 6:
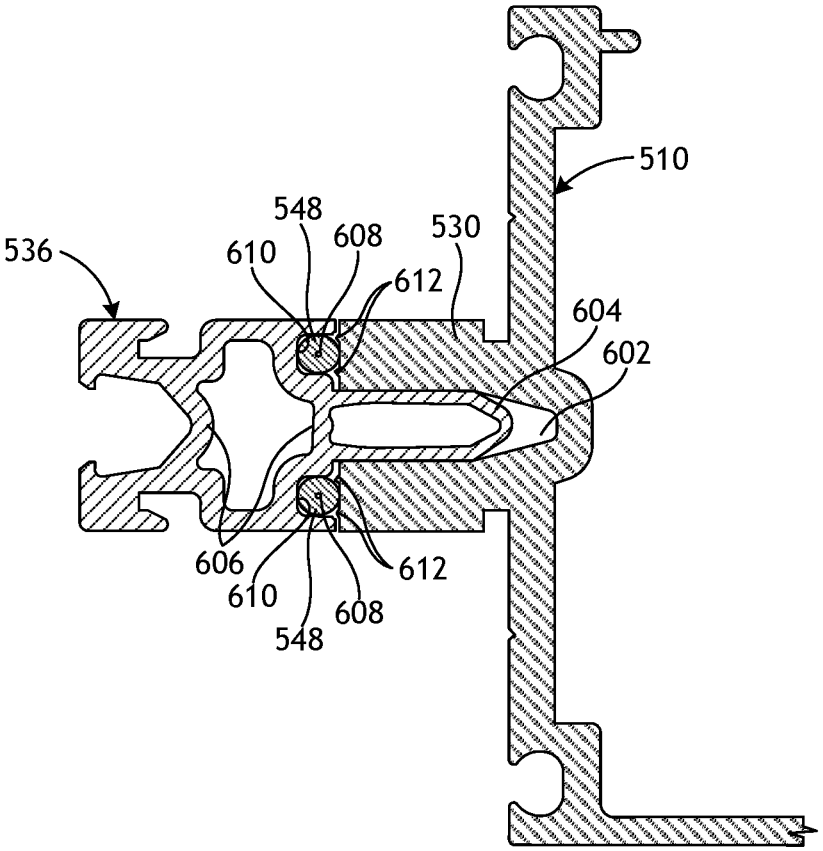
FIG. 6 is an enlarged cross-sectional side view of the transom and the tongue extension of FIG. 5.

FIG. 6 is an enlarged cross-sectional side view of the horizontal cross member 510 and the tongue extension 536, according to one or more embodiments. As illustrated, the tongue 530 may extend laterally from the horizontal cross member 510 and may define a cavity 602 sized and otherwise configured to receive a retainer tab 604 provided by the tongue extension 536. In some embodiments, the retainer tab 604 may be slightly larger than the cavity 602. In such embodiments, the retainer tab 604 may be received within the cavity 602 and may hold the tongue extension 536 in contact with the horizontal cross member 510 via an interference fit or the like and until a more permanent coupling is made.

As discussed above, the fastener 526 (FIG. 5) that secures the pressure plate 518 (FIG. 5) to the horizontal cross member 510 may also extend through the tongue extension 536. As illustrated, the tongue extension 536 may include one or more walls 606 (two shown), and the fastener 526 may penetrate the walls 606 as it is advanced toward the cavity 602. Upon entering the cavity 602, the threads of the fastener 526 may cut through the walls of the retainer tab 604 and bite into (e.g., grippingly engage) the inner walls of the cavity 602.

As indicated above, the rod gaskets 548 may be used to seal the interface between the tongue extension 536 and the horizontal cross member 510 and, more particularly, between the tongue extension 536 and the opposing tongue 530. While two rod gaskets 548 are depicted, more or less than two may be employed, including a single rod gasket 548, without departing from the scope of the disclosure. Each rod gasket 548 may be made of a seal material capable of facilitating a sealed interface against the tongue 530. Suitable seal materials for the rod gaskets 548 include, but are not limited to, rubber, an elastomer, a polymer, silicone, tape, or any combination thereof.

In one or more embodiments, each rod gasket 548 may include a cord 608 encapsulated or otherwise embedded within the seal material. The cord 608 may comprise, for example, a thread, a wire, or another elongate type of line. In at least one embodiment, the cord 608 may be made of a material that does not stretch or otherwise stretches very little. Suitable materials for the cord 608 include, but are not limited to, nylon, polyester, or any combination thereof. The cord 608 may help prevent the rod gasket 548 from stretching and otherwise expanding or contracting lengthwise or longitudinally upon being subjected to large temperature fluctuations or during installation into the tongue extension 536.

In some embodiments, as illustrated, each rod gasket 548 may be received into a corresponding pocket 610 defined on or otherwise provided by the tongue extension 536. In the illustrated embodiment, the rod gaskets 548 may be generally circular or ovoid in cross-section and the pockets 608 may be correspondingly circular or ovoid to be able to receive and accommodate the rod gaskets 548. In other embodiments, however, the cross-sectional shape of the rod gaskets 548 or the shape of the pockets 608 may comprise other shapes or designs, such as polygonal, without departing from the scope of the disclosure.

In some embodiments, the inner wall of each pocket 610 may extend more than 180° to enable the pockets 610 to retain the corresponding rod gaskets 548 in place once inserted. Moreover, in some embodiments, the rod gaskets 548 may protrude a short distance out of the corresponding pocket 610 when seated therein. This may allow the rod gaskets 548 to sealingly engage the opposing wall of the tongue 530 when the tongue extension 536 is compressed against the opposing tongue 530. Moreover, as the rod gaskets 548 are compressed against the tongue 530, the seal material may fill the corresponding pockets 610 and thereby provide a fluid tight sealed interface.

In at least one embodiment, one or more projections 612 may be defined on the tongue 530 adjacent the location of the sealed interface between the tongue extension 536 and the tongue 530. In some embodiments, the projections 612 may help enhance the sealed interface by preventing the seal material of the rod gaskets 548 from creeping along the sealed interface over time.

In some embodiments, the rod gaskets 548 may be extruded and coiled or otherwise rolled onto a wheel or reel for subsequent deployment. The manufactured rod gaskets 548 may be positioned within the corresponding pockets 610 via various manufacturing processes. In one embodiment, for example, the tongue extension 536 may be extruded and the rod gaskets 548 may be uncoiled (unwound) from the reel and simultaneously inserted into the corresponding pockets 610 during the extrusion process. In other embodiments, the rod gaskets 548 may be inserted into the corresponding pockets 610 (either manually or automated) following the extrusion of the tongue extension 536, without departing from the scope of the disclosure.

Figure 7:
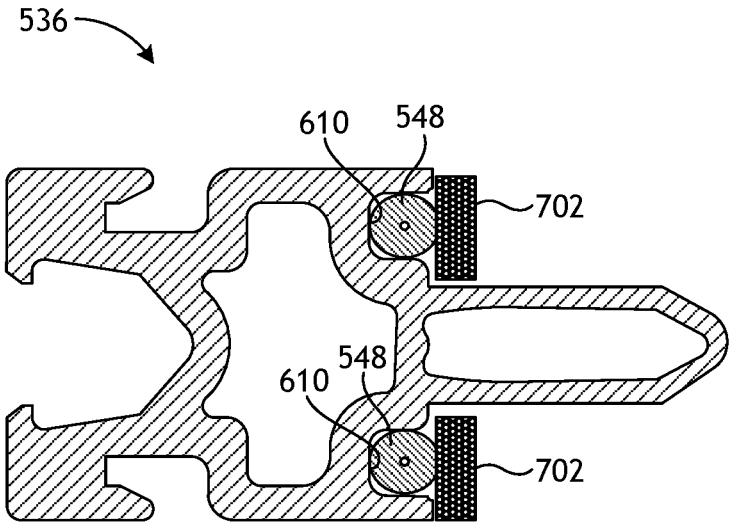
FIG. 7 is an enlarged cross-sectional view of another example embodiment of the tongue extension of FIG. 5.

FIG. 7 is an enlarged cross-sectional view of another example embodiment of the tongue extension 536, according to one or more additional embodiments. In the illustrated embodiment, a seal enhancement strip 702 may be coupled to or otherwise form part of one or both of the rod gaskets 548. In some embodiments, the seal enhancement strip 702 may be applied (e.g., adhered) to the rod gasket 548 after manufacturing the rod gasket 548. In other embodiments, however, the seal enhancement strip 702 may be manufactured with the rod gasket 548, such as through a dual durometer co-extrusion process. In such embodiments, the materials of the rod gasket 548 and the corresponding seal enhancement strip 702 may be fused into one uniform or consistent cross-section. In some embodiments, the seal enhancement strip 702 may help hold the corresponding rod gasket 548 within the pocket 610.

The seal enhancement strip 702 may be made of a variety seal materials capable of helping facilitate the sealed interface against the tongue 530. Suitable seal materials for the seal enhancement strip 702 include, but are not limited to, foam, rubber (e.g., ethylene propylene diene monomer or "EPDM", etc.), an elastomer, a polymer, silicone, or any combination thereof. In operation, the seal enhancement strip 702 is compressed against the opposing tongue to help the rod gasket 548 seal the interface between the tongue extension 536 and the horizontal cross member 510 and, more particularly, between the tongue extension 536 and the opposing tongue 530.

Figure 8:
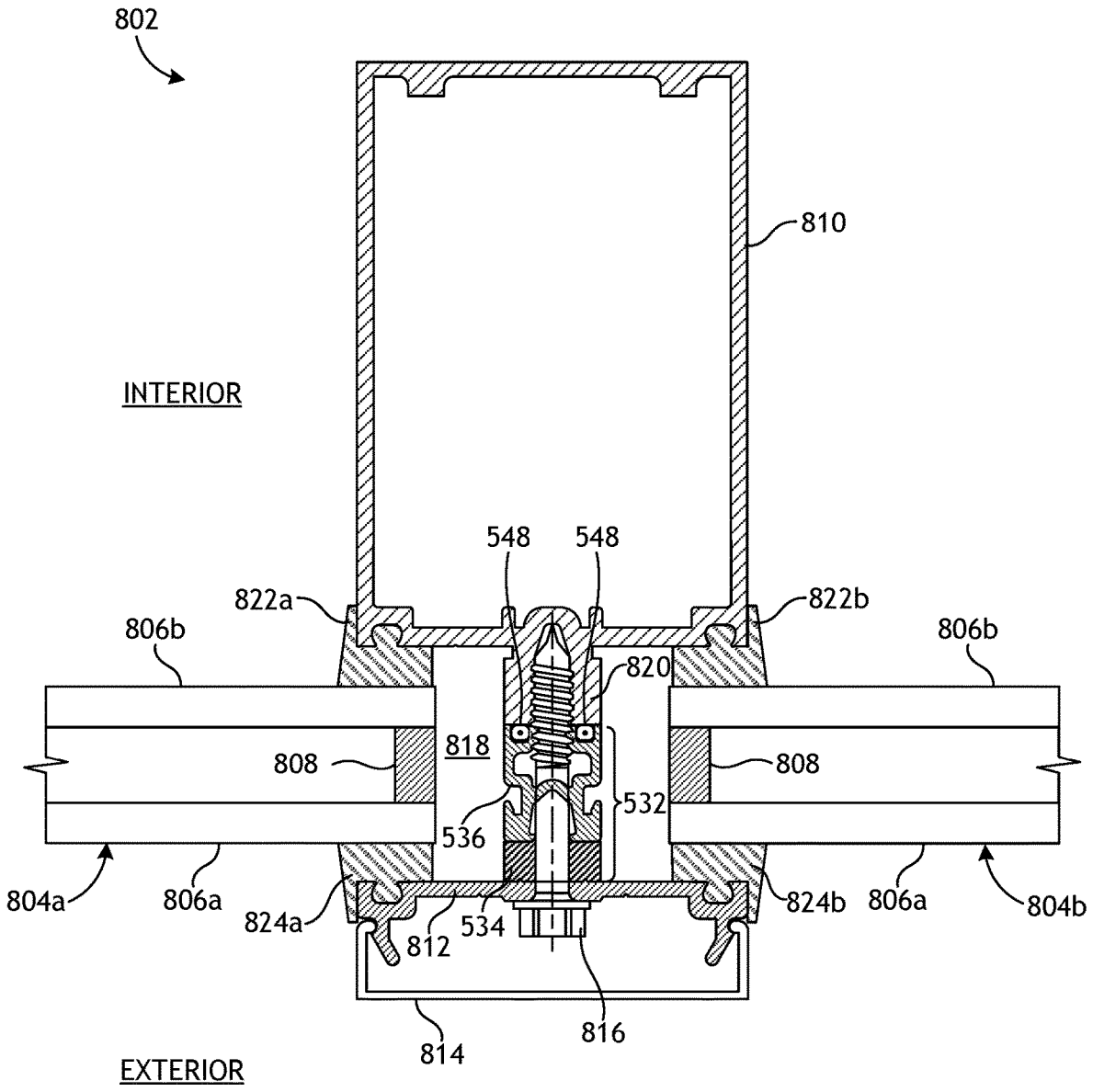
FIG. 8 is a cross-sectional side view of an example second, vertical element assembly taken along the lines 8-8 in FIG. 3.

FIG. 8 is a cross-sectional side view of an example vertical element assembly 802 as taken along the lines 8-8 in FIG. 3, according to one or more embodiments. The vertical element assembly 802 may be similar in some respects to the vertical elements 102*a,b* of FIG. 1 and may thus be vertically oriented. In some embodiments, the vertical element assembly 802 may replace one or both of the vertical elements 102*a,b*. Accordingly, the vertical element assembly 802 may not only form part of the window system 302 of FIG. 3, but may also form part of the window system 202 of FIG. 2. Moreover, the vertical element assembly 802 may be similar in some respects to the horizontal element assembly 502, and therefore may be best understood with reference thereto.

The vertical element assembly 802 may be configured to help laterally support and/or secure one or more panels, shown in FIG. 8 as a first panel 804*a* and a second panel 804*b*. The first and second panels 804*a,b* may be similar to the upper and lower panels 504*a,b* of FIG. 5, and thus may each comprise a conventional "double-glazed" window arrangement and may be referred to herein as the first and second "glazing" panels 804*a,b*. It will be appreciated, however, that the panels 804*a,b* may alternatively comprise one or more panes of window glass, one or more panes of polycarbonate, or one or more panels of material that are clear, translucent, tinted, or opaque, without departing from the scope of the disclosure. As illustrated, each glazing panel 804*a,b* includes a first or "exterior" glass panel 806*a* and a second or "interior" glass panel 806*b* with a spacer 808 positioned therebetween. The space between the first and second glass panels 806*a,b* may be insulated, as described above with reference to the glazing panels 504*a,b*. In at least one embodiment, one of the first and second panels 804*a,b* may be the same as one of the upper and lower panels 504*a,b*.

As illustrated, the vertical element assembly 802 may include a vertical member 810, alternately referred to as a "mullion." The vertical member 810 may also be referred to as a "transverse" member since it does not necessarily have to be perfectly vertical or otherwise orthogonal from a horizontal plane. The vertical member 810 may comprise a rigid extrusion made of aluminum, an aluminum alloy, or other material, including, but not limited to, other metals and alloys. The vertical member 810 may be coupled to the building structure, such as a beam (e.g., the beams 204 of FIG. 2) that forms part of the building structure.

The vertical element assembly 802 may further include a pressure plate 812 and a cover 814 removably coupled to the pressure plate 812. Aside from being vertically oriented, the pressure plate 812 and the cover 814 may be similar to the pressure plate 518 and the cover 520 of FIG. 5 and, therefore, will not be described again in detail. The pressure plate 812 may be operatively coupled to the vertical member 810 with a fastener 816, which may be a mechanical fastener, that extends through a glazing pocket 818 defined laterally between the vertical member 810 and the pressure plate 812. The glazing pocket 818 may also be defined horizontally between the first and second glazing panels 804*a,b*. In the illustrated embodiment, the fastener 816 comprises a screw that may be received within or otherwise threaded into a tongue 820 extending from or forming part of the vertical member 810.

Similar to the horizontal element assembly 502 of FIG. 5, the vertical element assembly 802 may include the thermal separator 532. In the illustrated embodiment, however, the thermal separator 532 may be vertically positioned within the glazing pocket 818 and may interpose and otherwise extend between the pressure plate 812 and the vertical member 810. Accordingly, the thermal barrier 534 may be positioned adjacent the inner wall of the pressure plate 812, and the tongue extension 536 may be positioned adjacent the vertical member 810 and, more particularly, the tongue 820. The fastener 816 may be configured to extend at least partially through or penetrate the thermal separator 532 to reach the vertical member 810 and, more particularly, the tongue 820.

A first interior gasket 822*a* and a second interior gasket 822*b* may interpose the first and second glazing panels 804*a,b*, respectively, and the vertical member 810. Similarly, a first exterior gasket 824*a* and a second exterior gasket 824*b* may interpose the first and second glazing panels 804*a,b*, respectively, and the pressure plate 812. The interior gaskets 822*a,b* may provide a substantially sealed interface between the glazing panels 804*a,b* and the vertical member 810 on the interior of a building, and the exterior gaskets 824*a,b* may provide a substantially sealed interface between the glazing panels 804*a,b* and the pressure plate 812 on the exterior of the building. Accordingly, the interior and exterior gaskets 822*a,b* and 824*a,b* may operate to help prevent the migration of fluids (e.g., water, air, etc.) into the glazing pocket 818.

Similar to the embodiment of FIG. 5, the thermal separator 532 may provide a sealed interface at one or both of its opposing sides against the vertical member 810 and the pressure plate 812, respectively. More particularly, at one side of the thermal separator 532, one or more rod gaskets 548 (two shown) may be configured to seal the interface between the tongue extension 536 and the opposing tongue 820. At the opposite side, the thermal barrier 534 may sealingly engage the inner wall of the pressure plate 812. Coupling the tongue extension 536 to the tongue 820 may be similar to coupling the tongue extension 536 to the tongue 530 of FIG. 5 described above, and therefore will not be discussed again.

The rod gaskets 548 that seal the interface between the tongue extension 536 and the opposing tongue 820 may operate in conjunction with the rod gaskets 548 that seal the interface between the tongue extension 536 and the opposing tongue 530 (FIG. 5) in the horizontal element assembly 502 (FIG. 5). More specifically, the rod gaskets 548 may provide a continuous seal around the opening which will compartmentalize the glazing pocket 528, 818 for each glazing unit. Consequently, any liquid entering the glazing pocket 528, 818 can weep out and not migrate to adjacent spaces.

Embodiments disclosed herein include:

A. A window system for a building includes a panel, a first element assembly that supports the panel and includes a cross member and a pressure plate laterally offset from the cross member, wherein a glazing pocket is defined between the cross member and the pressure plate, a thermal separator positioned within the glazing pocket and extending between the pressure plate and the cross member, the thermal separator including a tongue extension, and a rod gasket that seals an interface between the tongue extension and the cross member.

B. A method of sealing a portion of a window system includes supporting a panel with a first element assembly that includes a cross member and a pressure plate laterally offset from the cross member, wherein a glazing pocket is defined between the cross member and the pressure plate, positioning a thermal separator within the glazing pocket, the thermal separator extending between the pressure plate and the cross member and including a tongue extension, and sealing an interface between the tongue extension and the cross member with a rod gasket.

Each of embodiments A and B may have one or more of the following additional elements in any combination: Element 1: wherein the tongue extension defines a pocket that receives the rod gasket. Element 2: wherein an inner wall of the pocket extends more than 180° and a portion of the rod gasket protrudes from the pocket. Element 3: wherein the tongue extension is made of a polymer, fiberglass, or any combination thereof. Element 4: wherein the tongue extension comprises a polyamide extrusion. Element 5: wherein the rod gasket is made of a seal material selected from the group consisting of rubber, an elastomer, a polymer, silicone, and any combination thereof. Element 6: wherein the rod gasket includes a cord embedded within the seal material. Element 7: wherein the thermal separator is made of one or more materials having a thermal conductivity that is less than a thermal conductivity of one or both of the cross member and the pressure plate. Element 8: wherein the cross member provides a tongue that defines a cavity, and wherein the tongue extension provides a retainer tab receivable within the cavity. Element 9: further comprising a fastener that couples the pressure plate to the cross member, wherein the fastener extends at least partially through the tongue extension and into the cavity. Element 10: wherein the panel is selected from the group consisting of a glazing panel, a pane of window glass, a pane of polycarbonate, a clear panel, a translucent panel, a tinted panel, an opaque panel, and any combination thereof. Element 11: further comprising a seal enhancement strip coupled to the rod gasket to help seal the interface between the tongue extension and the cross member. Element 12: wherein the seal enhancement strip is made of a seal material selected from the group consisting of foam, rubber, an elastomer, a polymer, silicone, and any combination thereof. Element 13: further comprising a second element assembly that laterally supports the panel and includes a transverse member and a second pressure plate laterally offset from the transverse member, wherein a second glazing pocket is defined between the transverse member and the second pressure plate, a second thermal separator positioned within the second glazing pocket and extending between the second pressure plate and the transverse member, the second thermal separator including a second tongue extension, and a second rod gasket that seals an interface between the second tongue extension and the transverse member.

Element 14: wherein the panel is selected from the group consisting of a glazing panel, a pane of window glass, a pane of polycarbonate, a clear panel, a translucent panel, a tinted panel, an opaque panel, and any combination thereof. Element 15: wherein sealing the interface between the tongue extension and the cross member comprises receiving the rod gasket within a pocket defined in the tongue extension, wherein a portion of the rod gasket protrudes from the pocket, and compressing the portion of the rod gasket against the cross member. Element 16: further comprising preventing the rod gasket from stretching with a cord embedded within a seal material of the rod gasket. Element 17: wherein a seal enhancement strip is coupled to the rod gasket, the method further comprising cooperatively sealing the interface between the tongue extension and the cross member with the rod gasket and the seal enhancement strip. Element 18: further comprising laterally supporting the panel with a second element assembly that includes a transverse member and a second pressure plate laterally offset from the transverse member, wherein a second glazing pocket is defined between the transverse member and the second pressure plate, positioning a second thermal separator within the second glazing pocket, the second thermal separator extending between the second pressure plate and the transverse member and including a second tongue extension, and sealing an interface between the second tongue extension and the transverse member with a second rod gasket.

By way of non-limiting example, exemplary combinations applicable to A and B include: Element 1 with Element 2; Element 5 with Element 6; Element 8 with Element 9; and Element 11 with Element 12.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

Although various example embodiments have been disclosed, a worker of ordinary skill in this art would recognize that certain modifications would come within the scope of this disclosure. For that reason, the following claims should be studied to determine the scope and content of this disclosure.

What is claimed is:

1. A window system for a building, comprising:

a panel;

a first element assembly that supports the panel and includes a cross member and a pressure plate laterally offset from the cross member, wherein a glazing pocket is defined between the cross member and the pressure plate;

a tongue extending from the cross member into the glazing pocket and defining a cavity;

a thermal separator positioned within the glazing pocket and extending between the pressure plate and the cross member, the thermal separator including a tongue extension that provides a retainer tab; and a gasket arranged at an interface between the tongue extension and the tongue to seal the interface, wherein the retainer tab extends past the interface and is received within the cavity.

2. The window system of claim 1, wherein the gasket comprises a rod gasket and the tongue extension defines a pocket that receives the rod gasket.

3. The window system of claim 1, wherein the tongue extension is made of a polymer, fiberglass, or any combination thereof.

4. The window system of claim 1, wherein the tongue extension comprises a polyamide extrusion.

5. The window system of claim 1, wherein the gasket is made of a seal material selected from the group consisting of rubber, an elastomer, a polymer, silicone, and any combination thereof.

6. The window system of claim 1, wherein the thermal separator is made of one or more materials having a thermal conductivity that is less than a thermal conductivity of one or both of the cross member and the pressure plate.

7. The window system of claim 1, further comprising a fastener that couples the pressure plate to the cross member, wherein the fastener extends at least partially through the tongue extension and into the cavity.

8. The window system of claim 1, wherein the panel is selected from the group consisting of a glazing panel, a pane of window glass, a pane of polycarbonate, a clear panel, a translucent panel, a tinted panel, an opaque panel, and any combination thereof.

9. The window system of claim 1, further comprising a seal enhancement strip coupled to the gasket to help seal the interface between the tongue extension and the tongue.

10. The window system of claim 9, wherein the seal enhancement strip is made of a seal material selected from the group consisting of foam, rubber, an elastomer, a polymer, silicone, and any combination thereof.

11. The window system of claim 1, further comprising:

a second element assembly that laterally supports the panel and includes a transverse member and a second pressure plate laterally offset from the transverse member, wherein a second glazing pocket is defined between the transverse member and the second pressure plate;

a second thermal separator positioned within the second glazing pocket and extending between the second pressure plate and the transverse member, the second thermal separator including a second tongue extension; and a second gasket that seals an interface between the second tongue extension and the transverse member.

12. A method of sealing a portion of a window system, comprising:

supporting a panel with a first element assembly that includes a cross member and a pressure plate laterally offset from the cross member and thereby defining a glazing pocket between the cross member and the pressure plate, wherein the cross member provides a tongue extending into the glazing pocket and defining a cavity;

positioning a thermal separator within the glazing pocket, the thermal separator extending between the pressure plate and the cross member and including a tongue extension that provides a retainer tab; and sealing an interface between the tongue extension and the tongue with a gasket, wherein the retainer tab extends past the interface and is received within the cavity.

13. The method of claim 12, wherein sealing the interface between the tongue extension and the tongue comprises compressing the gasket against the tongue.

14. The method of claim 12, wherein a seal enhancement strip is coupled to the gasket, the method further comprising cooperatively sealing the interface between the tongue extension and the tongue with the gasket and the seal enhancement strip.

15. The method of claim 12, further comprising:

laterally supporting the panel with a second element assembly that includes a transverse member and a second pressure plate laterally offset from the transverse member, wherein a second glazing pocket is defined between the transverse member and the second pressure plate;

positioning a second thermal separator within the second glazing pocket, the second thermal separator extending between the second pressure plate and the transverse member and including a second tongue extension; and sealing an interface between the second tongue extension and the transverse member with a second gasket.

16. The window system of claim 1, wherein the thermal separator further includes a thermal barrier that interposes the tongue extension and the pressure plate.

17. The window system of claim 1, wherein the retainer tab comprises a closed-end structure that provides a wall penetrated by a fastener that couples the pressure plate to the cross member.

18. The window system of claim 1, further comprising one or more projections defined on the tongue adjacent the interface between the tongue extension and the tongue and operable to prevent the gasket from creeping along the interface over time.

19. The method of claim 12, further comprising preventing the gasket from creeping along the interface with one or more projections defined on the tongue adjacent the interface between the tongue extension and the tongue.

* * * * *